US005138662A

United States Patent [19]

Amano et al.

[11] Patent Number: 5,138,662

[45] Date of Patent: Aug. 11, 1992

[54] SPEECH CODING APPARATUS

[75] Inventors: Fumio Amano, Tokyo; Tomohiko Taniguchi, Yokohama; Yoshinori Tanaka, Kawasaki; Yasuji Ota, Yokohama; Shigeyuki Unagami, Atsugi, all of Japan

[73] Assignee: Fujitsu Limited, Kawasaki, Japan

[21] Appl. No.: 508,553

[22] Filed: Apr. 13, 1990

[30] Foreign Application Priority Data

Apr. 13, 1989 [JP] Japan ..... 1-093568

[51] Int. Cl.[5] ..... G10L 5/00

[52] U.S. Cl. ..... 381/36; 381/38; 381/40; 381/49; 395/2

[58] Field of Search ..... 364/513.5; 381/38-40, 381/49, 36; 395/2

[56] References Cited

U.S. PATENT DOCUMENTS 4,817,157 3/1989 Gerson .

OTHER PUBLICATIONS

Sharad Singhal "On Encoding Filter Parameters for Stochastic Coders" pp. 1633-1636 1987 IEEE.

M. R. Schroeder & B. S. Atal "Code-Excited Linear Prediction(CELP) High-Quality Speech at Very Low Bit Rates" pp. 937-940 1985 IEEE.

European Search Report Completed Feb. 28, 1991 by Examiner Armspach J.F.A.M. at The Hague.

Grant Davidson and Allen Gersho, Complexity Reduction Methods For Vector Excitation Coding, 1986 IEEE, pp. 3055-3058.

Akira Ichikawa, Shoichi Takeda and Yoshiaki Asakawa, "A Speech Coding Method Using Thinned--Out Residual", 1985 IEEE, pp. 961-964.

Richard C. Rose and Mark A. Clements, "All-Pole Speech Modeling With A Maximally Pulse-Like Residual", 1985 IEEE, pp. 481-484.

*Primary Examiner*—Emanuel S. Kemeny

*Attorney, Agent, or Firm*—Staas & Halsey

[57] ABSTRACT

A speech coding apparatus which selects an optimum code from a code book, the optimum code giving the minimum magnitude of error signal between the input signal and the reproduced signal obtained by a filter calculation using a linear prediction parameter from a linear predictive analysis unit with respect to the codes of the code book, wherein the code book is formed by thinning to 1/M (M being an integer of two or more) the plurality of sampling values constituting the codes. To compensate for the deterioration of the quality of the reproduced signal caused by thinning the sampling values in this way, an additional linear predictive analysis unit is further introduced and use made of an amended linear prediction parameter instead of the linear prediction parameter from the originally provided linear predictive analysis unit.

13 Claims, 12 Drawing Sheets

| Fig. 7A | Fig. 7B |
|---|---|

SPEECH CODING APPARATUS

BACKGROUND OF THE INVENTION

1. Field of the Invention

The present invention relates to a speech coding apparatus and, more particularly, to a speech coding apparatus which operates with a high quality speech coding method.

By using a speech coding apparatus which operates with a high quality speech coding method, the following three advantages can be obtained in a digital communication system:

a) In general, using this method it is possible to band compress a digital speech signal transmitted at 64 kbps to, for example, 8 kbps, and, it is possible to transmit the digital speech signal at a very low bit rate. This can be a factor for reducing the so-called line transmission costs.

b) It becomes easy to simultaneously transmit speech signals and nonspeech signals (data signals). Therefore, there is a greater economic merit to the communication system and much greater convenience to the user.

c) When the transmission line making up the transmission system is a wireless transmission line, the radio frequency can be used much more efficiently and, in a communication system provided with a speech storage memory, a greater amount of speech data can be stored with the same memory capacity of the speech storage memory as before compression.

With the above-mentioned three advantages, the speech coding apparatus with a high quality speech coding method can be expected to be useful for the following systems:

1) Intraoffice digital communication systems,

2) Digital mobile radio communication systems (digital car telephones),

3) Speech data storage and response systems.

In this case, in a speech coding apparatus used for the communication systems of the above 1) and 2), it becomes important that, first, real time processing is possible and, second, the apparatus be constructed compactly.

2. Description of the Related Art

There are human operators on both the transmission side and reception side of a speech communication system. That is, signals expressing human speech (speech signals) serve as the medium for communication. These speech signals, as is known, include considerable redundancy. Redundancy means that there is a correlation between adjacent speech samples and also between samples separated by some periodic duration. If one takes into account this redundancy, when transmitting or storing speech signals, it becomes possible to reproduce speech signals of a sufficiently good quality even without transmitting or storing completely all the speech signals. Based on this observation, it is possible to remove the above-mentioned redundancy from the speech signals and compress the speech signals for greater efficiency. This is what is referred to as a high quality speech coding method. Research is proceeding in different countries on this at the present time.

Various forms of this high quality speech coding method have been proposed. One of these is the "code-excited linear prediction" speech coding method (hereinafter referred to as the CELP method). This CELP method is known as a very low bit rate speech coding method. Despite the very low bit rate, it is possible to reproduce speech signals with an extremely good quality.

Details of the conventional speech coding apparatus based on the CELP method will be given later, but note that there is a very grave problem involved with this method. The problem is the massive amount of digital calculations required for encoding speech. Therefore, it becomes extremely difficult to perform speech communication in real time. Theoretically, realization of such a speech coding apparatus enabling real time speech communication is possible, but a supercomputer would be required for the above digital calculations. This being so, it would be impossible to make a compact (handy type) speech coding apparatus in practice.

SUMMARY OF THE INVENTION

Therefore, the present invention has as its object the realization of a speech coding apparatus able to perform speech communication in real time without enlargement of the circuits.

To achieve the above-mentioned object, first, each of a plurality of white noise series stored in a code book in the form of code data has the sampling values constituting those white noise series thinned out at predetermined intervals and, preferably, a compensating means is introduced which compensates for the deterioration of the quality of the reproduced speech caused by the thinning out of the above sampling values.

BRIEF DESCRIPTION OF THE DRAWINGS

The above object and features of the present invention will be more apparent from the following description of the preferred embodiments with reference to the accompanying drawings, wherein.

DESCRIPTION OF THE PREFERRED EMBODIMENTS

Before describing the embodiments of the present invention, the related art and the disadvantages therein will be described with reference to the related figures.

Figure 1:
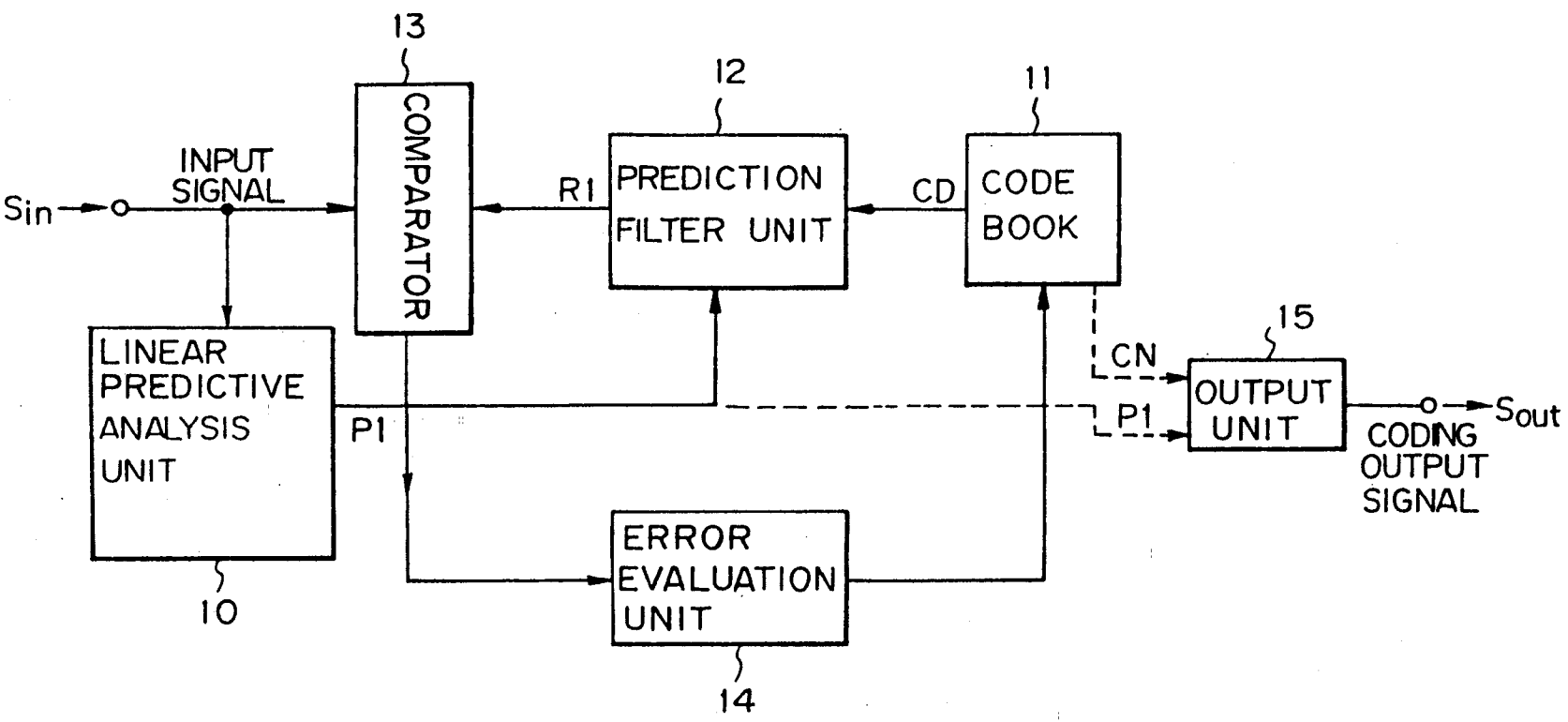
Fig. 1 PRIOR ART
FIG. 1 is a block diagram of the principle and construction of a conventional speech coding apparatus based on the CELP method.

FIG. 1 is a block diagram of the principle and construction of a conventional speech coding apparatus based on the CELP method. In the FIGURE, $S_{in}$ is a digital speech input signal which, on the one hand, is applied to a linear predictive analysis unit 10 and on the other hand is applied to a comparator 13. The linear predictive analysis unit 10 extracts a linear predictive parameter P by performing linear prediction on the input signal $S_{in}$. This linear predictive parameter $P_1$ is supplied to a prediction filter unit 12. This prediction filter unit 12 uses the linear predictive parameter $P_1$ for filtering calculations on a code CD output from the code book 11 and obtains a reproduced signal $R_1$ in the output. In the code book 11 is stored in a code format a plurality of types of white noise series.

The above-mentioned reproduced signal $R_1$ and the above-mentioned input signal $S_{in}$ are compared by a comparator 13 and the error signal between the two signals is input to an error evaluation unit 14. This error evaluation unit 14 searches in order through all the codes CD in the code book 11, finds the error signal ER ($ER_1$, $ER_2$, $ER_3$, . . .) with the input signal $S_{in}$, and selects the code CD giving the minimum power of the error signal ER therein. The optimum code number CN, the linear predictive parameter $P_1$, etc. are supplied to the output unit 15 and become the coding output signal $S_{out}$. The output signal $S_{out}$ is transmitted to the distant reception apparatus through, for example, a wireless transmission line.

Figure 2:
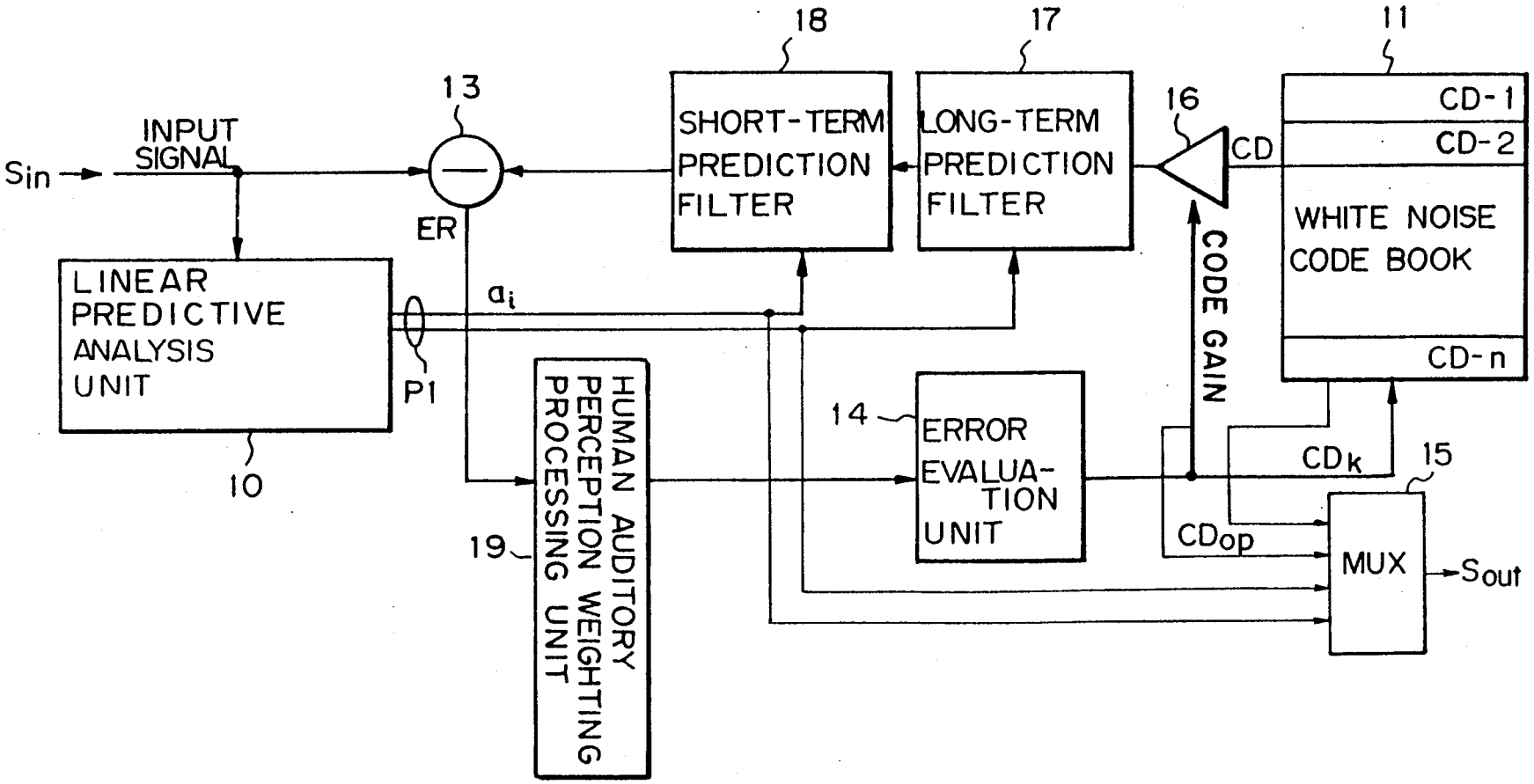
Fig. 2 PRIOR ART
FIG. 2 is a block diagram showing more concretely the constitution of FIG. 1.

FIG. 2 is a block diagram showing more concretely the constitution of FIG. 1. Note that constitutional elements that are the same throughout the figures are given the same reference numerals or symbols.

First, speech is produced by the flow of air pushed out of the lungs to create a sound source of vocal cord vibration, turbulent noise, etc. This is given various tones by modifying the shape of the speech path. The language content of the speech is mostly the part expressed by the shape of the speech path but the shape of the speech path is reflected in the frequency spectrum of the speech signal, so the phoneme information can be extracted by spectral analysis.

One method of such spectral analysis is the linear predictive analysis method, which analysis method is based on the idea that the sampling values of speech signals are approximated by the linear coupling of sampling values of several samples times previously.

Therefore, the digital input signal $S_{in}$ is extracted beforehand in a processing frame of a length of, for example, 20 ms, and applied to the linear predictive analysis and processing unit 10, then the spectral envelope of the processed frame is subjected to predictive analysis and the linear prediction coefficient $a_i$ (for example, $i=1, 2, 3 \ldots 10$), the pitch period, and the pitch prediction coefficient are extracted. The linear prediction coefficient $a_i$ is applied to a short-term prediction filter 18 and the pitch period and pitch prediction coefficient are applied to a long-term prediction filter 17.

Further, a residual signal is obtained by linear predictive analysis, but this residual signal is not used as a drive source in the CELP method. While noise waveforms are used as a drive source. Further, the short term prediction filter 18 and long-term prediction filter 17 are driven by the input "0" and subtract from the input signal $S_{in}$ so as to remove the effects of the preceding processing frame.

In the white noise code book 11, the series of white noise waveforms used as the drive source is stored as a code CD. The level of the white noise waveforms is normalized. Next, the white noise code book 11, formed by digital memory, outputs a white noise waveform corresponding to the input address, that is, the code number $CD_k$. Since this white noise waveform is normalized as mentioned above, it passes through an amplifier 16 having a gain obtained by a predetermined evaluation equation, then-the long-term prediction filter 17 performs prediction of the pitch period and the short-term prediction filter 18 performs prediction between close sampling values, whereby the reproduced signal $R_1$ is created. This signal $R_1$ is applied to the comparator 13. The difference of the reproduced signal $R_1$ from the input signal $S_{in}$ is obtained by the comparator 13 and the resultant error signal ($S_{in}-R_1$) ER is weighted by the human auditory perception weighting processing unit 19 through matching of the human auditory spectrum to the spectrum of the white noise waveforms. In the error evaluation unit 14, the squared sum of the level of the auditory weighted error signal ER is taken and the error power is evaluated for each later-mentioned subprocessing frame (for example, of 5 ms). This evaluation is performed four times within a single processing frame (20 ms) and is performed similarly for all of the codes in the white noise code book 11, for example, each of 1024 codes. Based on this evaluation, a single code number CN providing the minimum error power in all the codes CD is selected. This designates the optimum code with respect to the input signal $S_{in}$ being now given. This is the optimum code. As the method for obtaining the optimum code, use is made of the well known analysis-by-synthesis (ABS) method. Together with the linear prediction coefficient $a_i$, etc., the code number CN corresponding to the optimum code is supplied to the output unit 15, where the $a_i$, CN, etc. are multiplexed to give the coded output signal $S_{out}$.

The value of the linear prediction coefficient $a_i$ does not change within a single processing frame (for example, 20 ms), but the code changes with each of the plurality of subprocessing frames (for example, 5 ms) constituting the processing frame.

Figure 3:
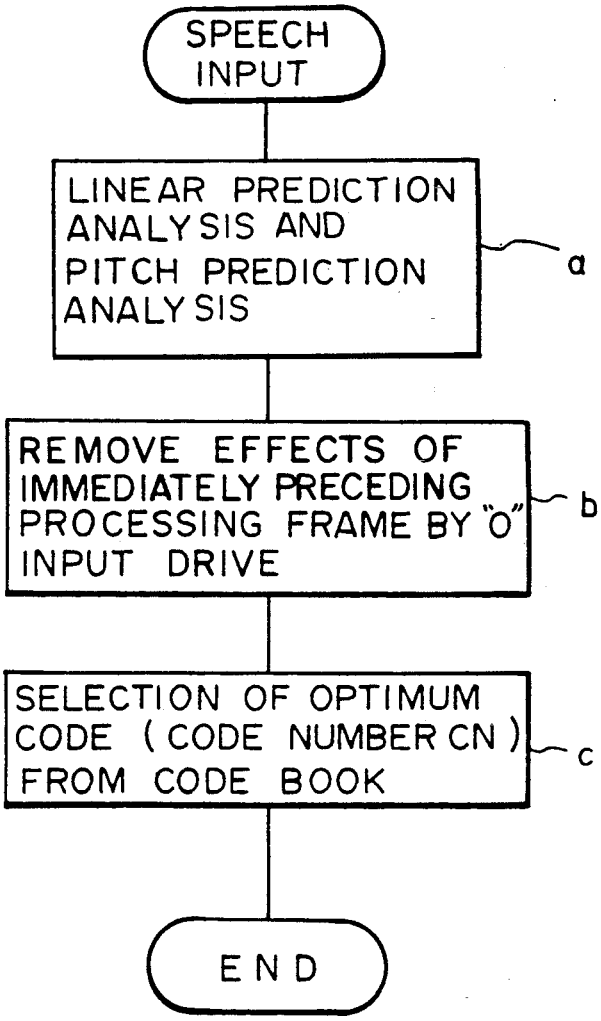
Fig. 3 PRIOR ART
FIG. 3 is a flow chart of the basic operation of the speech coding apparatus shown in FIG. 2.

FIG. 3 is a flow chart of the basic operation of the speech coding apparatus shown in FIG. 2. At step a, the linear predictive analysis unit 10 performs linear predictive analysis ($a_i$) and pitch predictive analysis on the digital speech input signal $S_{in}$.

At step b, a "0" input drive is performed to the prediction filter unit 12' (see FIG. 7) of the same constitution of the prediction filter unit 12 to remove the effects of the immediately preceding processing frame, then in that state the error signal ER for the next processing frame is found by the comparator 13. Explaining this in more detail, the prediction filter unit 12 is constituted by so-called digital filters, in which are serially connected a plurality of delay elements. Immediately after the CD from the code book 11 is input to the prediction filter unit 12, the internal state of the prediction filter unit 12 does not immediately become 0. The reason for this is that there is still code data remaining in the above-mentioned plurality of delay elements. This being so, at the time when the coding operation for the next processing frame is started, the code data used in the immediately preceding processing frame still remains in the prediction filter unit 12 and high precision filtering calculations cannot be performed in the next processing frame appearing after the immediately preceding processing frame.

Therefore, the above-mentioned prediction filter unit 12' is driven by the "0" input and when a comparison is made with the input signal $S_{in}$ in the comparator 13, the output of the other prediction filter unit 12' is subtracted from the signal $S_{in}$.

At step c, selection is made of the above-mentioned optimum code (code number CN) in the code book 11 able to give a reproduced signal $R_1$ most approximating the currently given input signal $S_{in}$.

In the above way, to obtain the optimum code, it is necessary to calculate the reproduced signal $R_1$ for each of the subprocessing frames and, further, for all of the codes, so convolution calculations, that is $$\Sigma H_i \cdot C^k_{n-i}$$

(filter calculations), must be performed between the transfer function H of the prediction filter unit 12 comprised by the short-term prediction filter 18 and the long-term prediction filter 17 and the code CD for each subprocessing frame.

Here, if the degree of the above-mentioned transfer function H is N, in a single convolution calculation, N number of accumulating calculations have to be performed. Further, if the size of the white noise code book is K, then K·N number of multiplication operations substantially have to be carried out as the total amount of calculations.

Therefore, the previously mentioned problems occur that the required amount of calculations becomes massive and it is difficult to achieve a speech coding apparatus of a small size which can operate in real time.

Figure 4:
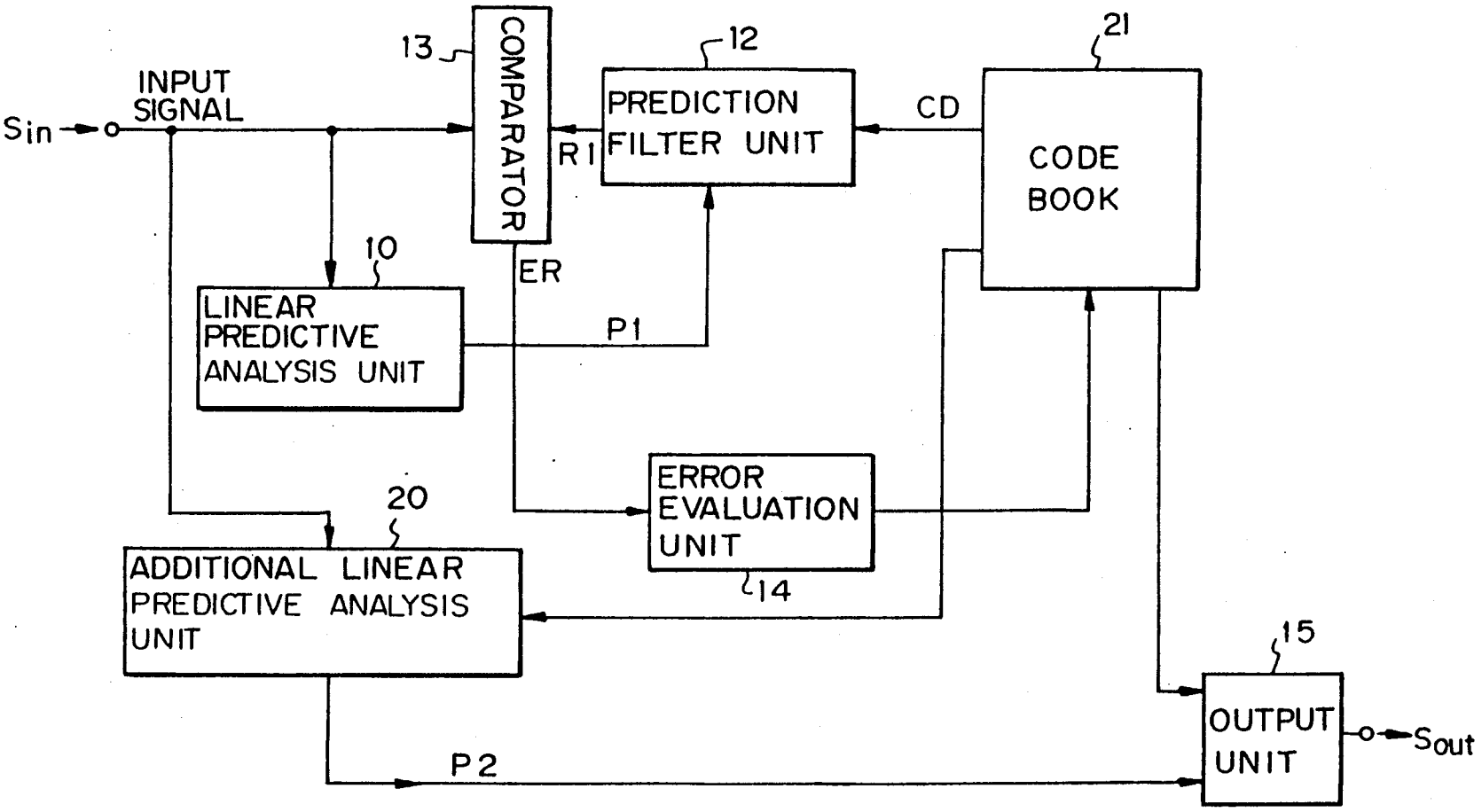
Fig. 4 is a block diagram of the principle and construction of a speech coding apparatus based on the present invention.

FIG. 4 is a block diagram of the principle and construction of a speech coding apparatus based on the present invention. The difference with the conventional speech coding apparatus shown in FIG. 1 is that the code book 11 of FIG. 1 is replaced by a code book 21. The new code book 21 stores in a code thinned out to 1/M the number of the plurality of sampling values which each code should inherently have. By doing this, the amount of calculations required for the afore-mentioned convolution calculations is required to be only 1/M. As a result, it becomes possible to have the speech coding processing performed in real time. Further, a one-chip digital signal processor (DSP) can be used to realize the speech coding apparatus without use of a supercomputer as mentioned earlier.

Since the plurality of sampling values making up the codes in the code book 21 are thinned to 1/M, the quality of the reproduced signal $R_1$ would seemingly deteriorate. If so, then a high precision speech coded output signal $S_{out}$ cannot be obtained. Therefore, more preferably, a means is introduced for compensating for the deterioration of quality of the reproduced signal made by thinning the above-mentioned sampling values to 1/M. In FIG. 4, an additional linear predictive analyzing and processing unit 20 is used as that compensating means.

The additional linear predictive analysis unit 20 receives from the code book 21 the optimum code obtained using the linear prediction parameter $P_1$ calculated by the linear predictive analysis unit 10 and calculates an amended linear prediction parameter $P_2$ cleared of the effects of the optimum code. The output unit 15 receives as input the parameter $P_2$ instead of the conventional linear prediction parameter $P_1$ and further receives as input the code number CN corresponding to the previously obtained optimum code so as to output the coded output signal $S_{out}$.

The additional linear predictive analysis unit 20 preferably calculates the amended linear prediction parameter $P_2$ in the following way. The processing unit 20 calculates the linear prediction parameter giving the minimum squared sum of the residual after elimination of the effects of the optimum code from the input signal $S_{in}$ and uses the results of the calculation as the amended linear prediction parameter $P_2$.

The present invention stores as codes in a white noise code book 21 the white noise series obtained by thinning to 1/M the white noise series of the codes which should be present in an ordinary code book.

Therefore, there is one significant sampling value in M number of sampling values in each code CD. This being so, it is sufficient that the number of accumulating calculations required for a single convolution calculation be N/M (N being the order of the transfer function H mentioned earlier, that is, the number of sampling values of each code) and it is possible to reduce to substantially 1/M the amount of the filter calculations required for obtaining a reproduced signal $R_1$. However, the quality of the reproduced signal deteriorates the larger the value of M and compensation for this deterioration if required, as will soon be explained.

The plurality of sampling values in the codes are thinned at predetermined intervals. Various thinning methods may be considered such as one out of every two or one out of every three. If one out of every two, the thinning rate is $\frac{1}{2}$ ($1/M=\frac{1}{2}$) and if one out of every three the thinning rate of $\frac{1}{3}$ ($1/M=\frac{1}{3}$). Practically, a thinning rate of $\frac{1}{2}$ or $\frac{1}{3}$ is preferable. With a thinning rate of this extent, it is possible to form the prediction filter unit 12 by a small sized digital signal processor (DSP). If the thinning rate is made larger ($\frac{1}{4}$, 1/5, . . .), the prediction filter unit 12 may be realized by an even simpler processor.

To thin to 1/M the N number of sampling values in the codes, only one out of every M number of sampling values is used as significant data and the remaining sampling values (thinned codes) are all assigned the data value "0".

Figure 5:
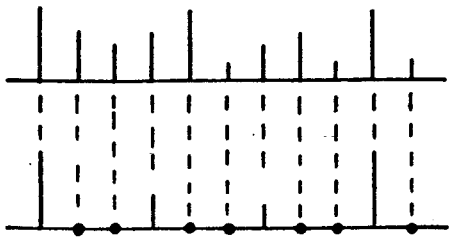
FIG. 5 is a view of an example of the state of thinning out of sampling values in a code book.

FIG. 5 is a view of an example of the state of thinning out of sampling values in a code book. The top portion of the FIGURE shows part of N number, for example, 40, sampling values which should inherently be present as codes in a code book. The bottom portion of the FIGURE shows the state where the sampling values of the top portion are thinned to, for example, $\frac{1}{3}$. The small black dots in the FIGURE show the sampling values of data value "0".

As stated earlier, as the thinning rate 1/M is made larger than $\frac{1}{2}$ or $\frac{1}{3}$, that is, $\frac{1}{4}$, 1/5, etc., the real time characteristic of the speech coding speed can be more easily ensured and the prediction filter unit 12 can be realized by a simpler and smaller sized processor. As a consequence, however, the deterioration of quality of the reproduced signal $R_1$ becomes larger.

Then, the input signal $S_{in}$ and the reproduced signal $R_{in}$ are compared by the comparator 13 and the optimum code giving the minimum level of the resultant error signal ER is selected, as in the past, by the error evaluation unit 14, then recalculation is performed by the additional linear predictive analysis unit 20 so as to amend the linear prediction parameter $P_1$ (mainly the linear prediction coefficient $a_i$) according to the present invention and improve the quality of the reproduced signal $R_1$. The method of improvement will be explained below.

Figure 6A:
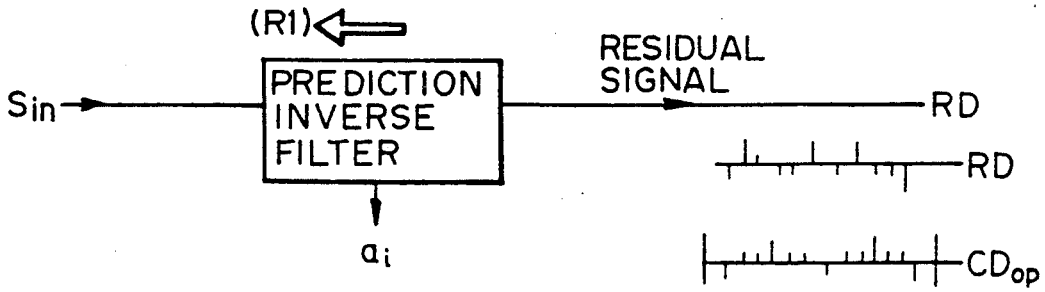
FIGS. 6A, 6B, 6C, and 6D are views explaining the effects of introduction of an additional linear predictive analysis unit.

FIGS. 6A, 6B, 6C, and 6D are views explaining the effects of introduction of an additional linear predictive analysis unit. FIG. 6A shows the input and output of a prediction inverse filter. The prediction inverse filter in the FIGURE shows the key portions of the linear predictive analysis unit shown in FIG. 1 and extracts the linear prediction coefficient $a_i$ forming the main portion of the linear prediction parameter $P_1$. That is, if the input signal $S_{in}$ is made to pass through the prediction inverse filter of FIG. 6A, the linear prediction coefficient $a_i$ will be extracted and the residual signal RD will be produced. This residual signal RD is inevitably produced since the correlation of the input signal $S_{in}$ and the optimum code is not perfect. Therefore, if the residual signal RD is used as an input and the prediction inverse filter is driven in the direction of the bold arrow in FIG. 6A, a reproduced signal ($R_1$) completely equivalent to the input signal $S_{in}$ should be obtained.

Nevertheless, in the present invention, is in the CELP method, the residual signal RD is not used to obtain the reproduced signal, but the optimum code $CD_{op}$ selected from among the plurality of codes CD in the white noise code book 21 is used to obtain the reproduced signal $R_1$. A portion of an example of the white noise waveform of the optimum code $CD_{op}$ is drawn in FIG. 6A. Further, a portion of an example of the waveform of the residual signal RD is also drawn in the FIGURE.

Figure 6B:
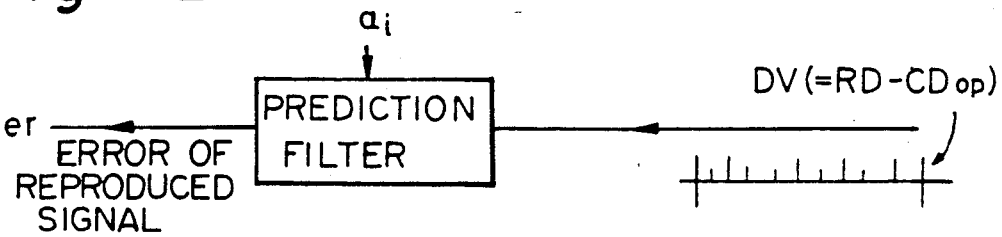

FIG. 6B shows the input and output of a prediction filter, which prediction filter is the key portion of the prediction filter unit 12 of FIG. 4. As mentioned above, if the residual signal RD is made to pass through the prediction filter of FIG. 6B, then a reproduced signal ($R_1$) substantially equivalent to the input signal $S_{in}$ can be obtained, so in actuality an optimum code $CD_{op}$ which is not completely equivalent to the signal RD is passed through the prediction filter of FIG. 6B, so the input of the filter will inherently include a deviation component DV of ($RD-CD_{op}$). In FIG. 6B is drawn of portion of an example of the waveform of the deviation component DV. Therefore, the output of the prediction filter (FIG. 6B) includes an error er of the reproduced signal corresponding to the deviation component DV.

Figure 6C:
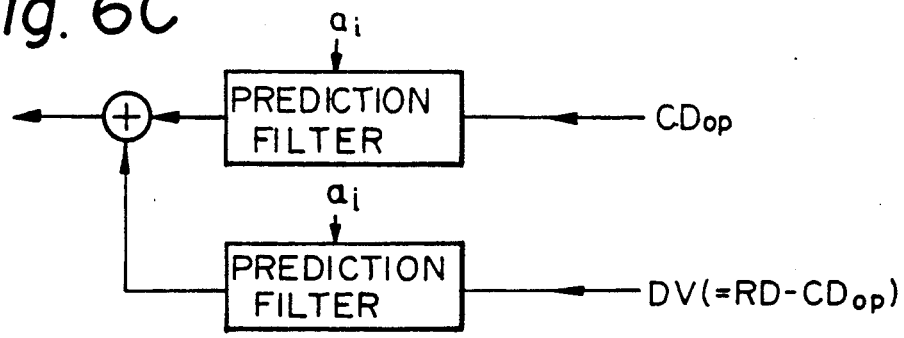

Here, consideration will be given to the construction of the prediction filters shown in FIG. 6C based on the input and output relationship of the filters explained in FIG. 6A and 6B. The optimum code $CD_{op}$ is made to pass through the first filter (top portion) in FIG. 6C to obtain a first reproduced signal, while the deviation component DV ($=RD-CD_{op}$) is made to pass through the second filter (bottom portion) to obtain a second reproduced signal. If these first and second reproduced signals are added, a strict reproduced signal ($R_1$), that is, a reproduced signal substantially equivalent to the input signal $S_{in}$, is obtained. This may be easily deduced from the fact that the sum of the input components of the first and second filters is $CD_{op}+RD-CD_{op}$ ($=RD$). Note that the linear pre coefficient $a_i$ is not set so as to give the minimum reproduced signal from the filter receiving as input the deviation component DV ($=RD-CD_{op}$). The linear prediction coefficient $a_i$ is set so as to give the minimum squared sum of the levels of the residual signals of the sampling values of the codes, that is, the power. That is, in the present invention, use is made of the code book 21 storing codes made of sampling values thinned to 1/M, so the linear prediction coefficient $a_i$ is set to give the minimum residual power overall of the selected sampling value. Thus $a_i$ is not set to give the minimum deviation component DV ($=RD-CD_{op}$) in FIG. 6C.

Figure 6D:
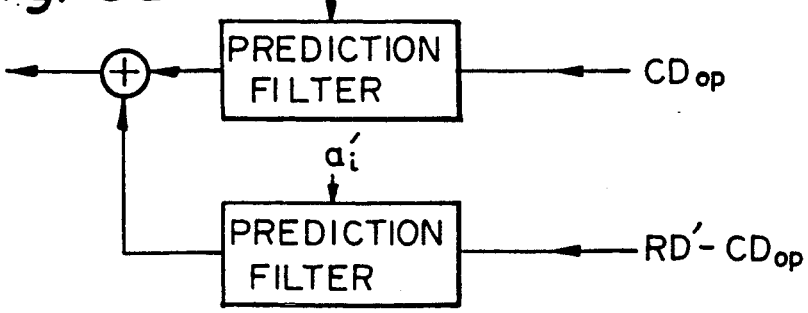

Therefore, to reduce the error er of the reproduced signal, the additional linear predictive analysis unit 20 of FIG. 4 again calculates the amended linear prediction parameter $P_2$ (mainly the linear prediction coefficient $a_i'$) by applying the optimum code $CD_{op}$ to a first prediction filter so as to give the minimum power of the residual signal cleared of the effects of the optimum code $CD_{op}$. The amended linear prediction coefficient $a'_i$ is set to give the minimum deviation component ($=RD'-CD_{op}$), as shown in FIG. 6D and this minimum deviation component is applied to a second production filters where the above-mentioned RD' is the residual signal obtained when passing the input signal $S_{in}$ through the prediction inverse filter (additional linear predictive analysis unit 20).

As a result of this operation the error er of the reproduced signal becomes smaller than even the case of use of the afore-mentioned deviation component ($=RD-CD_{op}$) and the deterioration of the reproduced signal can be minimized.

Figures 7, 7A:
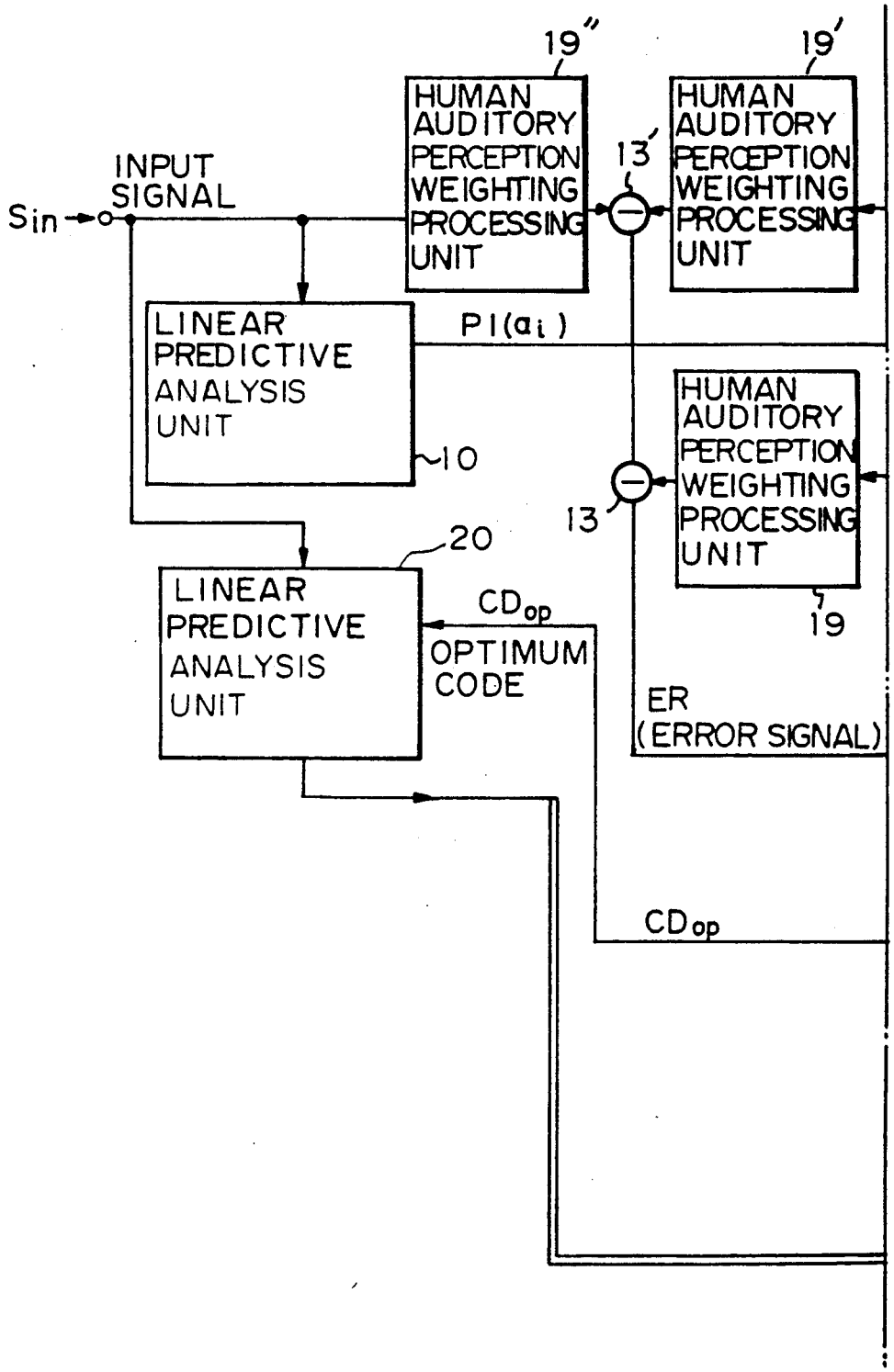
FIG. 7 and 7A and 7B form a block diagram of an embodiment of a speech coding apparatus based on the present invention.
Figure 7B:
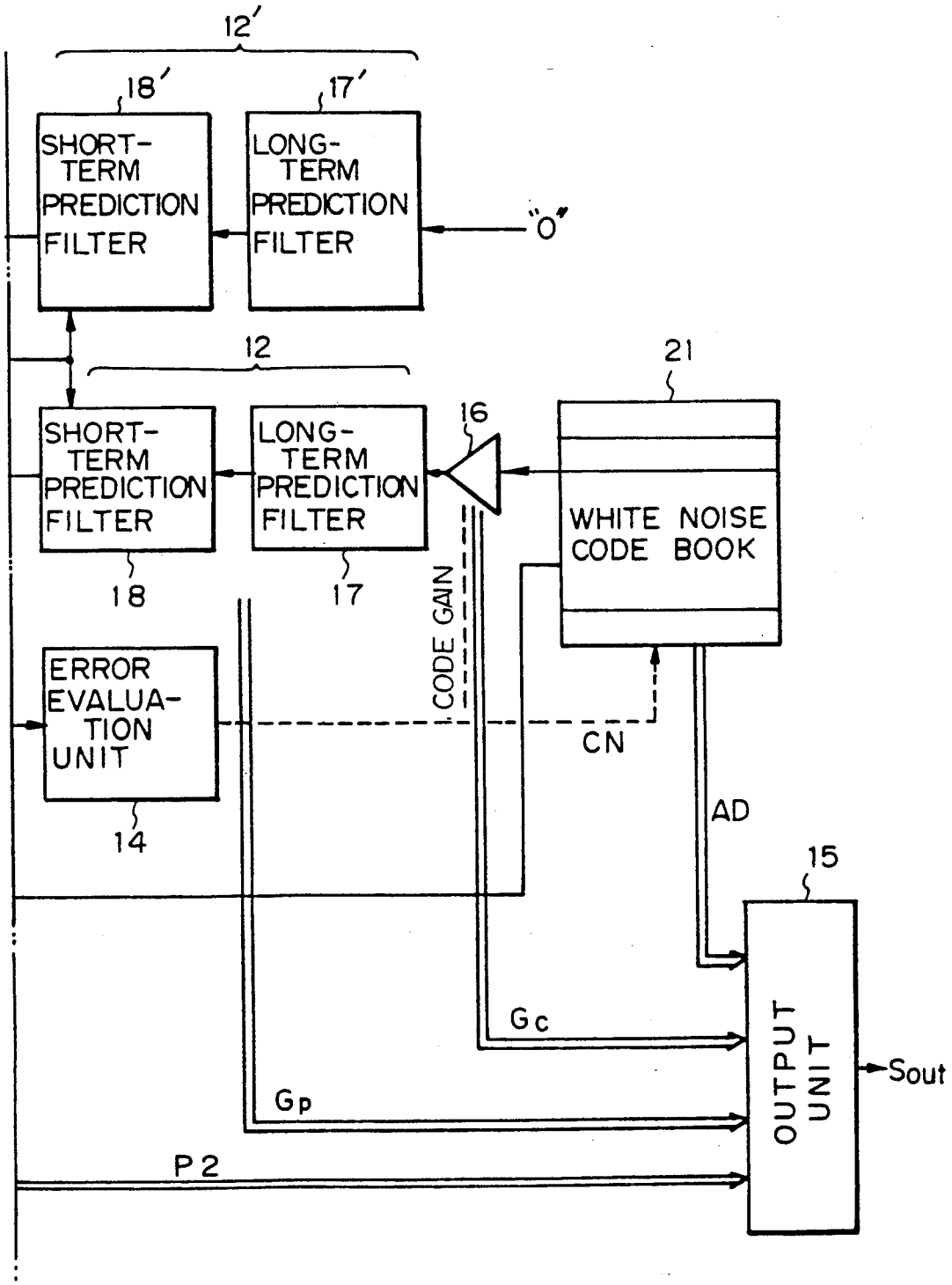
Figure 8:
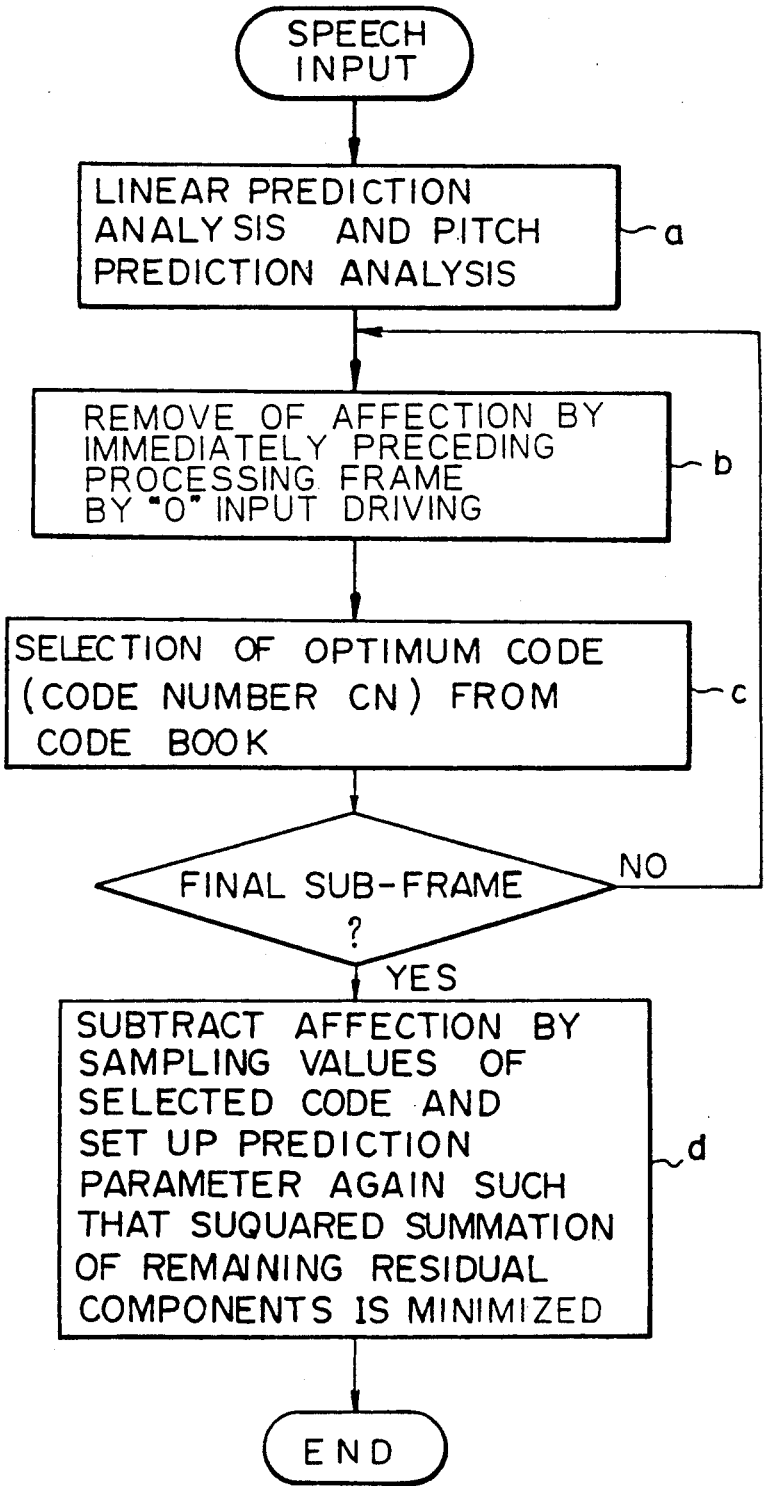
FIG. 8 is a flow chart of the basic operation of the speech coding apparatus shown in FIG. 7.

FIG. 7 is a block diagram of an embodiment of a speech coding apparatus based on the present invention. FIG. 8 is a flow chart of the basic operation of the speech coding apparatus shown in FIG. 7. Note that step a, step b, and step c in FIG. 8 are the same as step a, step b, and step c in FIG. 3.

The constitutional elements newly shown in FIG. 7 are the human auditory perception weighting processing units 19' and 19'', the comparator 13', the short-term prediction filter 18', and the long-term prediction filter 17'. These constitutional elements, as explained in step c of FIG. 3, function to remove the effects of the immediately preceding processing frame. Further, the output unit 15 is realized by a multiplexer (JX). The various signals input to the multiplexer (MUX) 15 and multiplexed are an address AD of the code book 21 corresponding to the optimum code ($CD_{op}$), the code gain $G_c$ used in an amplifier 16, the long prediction parameter used in the long-term prediction filter 17, and the so-called period gain $G_p$ and amended linear prediction parameter $P_2$ (mainly the linear prediction coefficient $a'_i$).

Referring to the flow chart of FIG. 8, an explanation will be made of the basic operation of the speech coding apparatus shown in FIG. 7. Further, the white noise code book 21 has sampling values thinned to ⅓, i.e, M=3, compared with the original code book.

First, the input signal $S_{in}$ is applied to the linear predictive analysis unit 10, where predictive analysis and pitch predictive analysis are performed, the linear predictive coefficient $a_i$, the pitch period, and the pitch prediction coefficient are extracted, and the linear predictive coefficient $a_i$ is applied to the short-term prediction filters 18 and 18, and the pitch period and pitch prediction coefficient are applied to the long-term prediction filters 17 and 17' (see step a in FIG. 8).

Further, the short-term prediction filter 18' and the long-term prediction filter 17, are driven by an "0" input under the applied extracted parameters, the input signal $S_{in}$ is subtracted from, and the effects of the processing frame immediately before are eliminated (see step b of FIG. 8).

Now, the white noise waveform output from the white noise code book 21 thinned to $\frac{1}{3}$ passes through the amplifier 16, whereafter the pitch period is predicted by the long-term prediction filter 17, the correlation between the adjacent samplings is predicted by the short-term prediction filter 18 and the reproduced signal $R_1$ is produced, weighting is applied in the form of matching with the human speech spectrum by the human auditory perception weighting processing unit 19, and the result is applied to the comparator 13.

Since the input signal $S_{in}$, which has passed through the human auditory perception weighting processing unit 19'' through the comparator 13', is applied to the comparator 13, the error signal ER after removal of various error components is applied to the error evaluation unit 14. In this evaluation unit 14, the squared sum of the error signal ER is taken, whereby the error power in the subprocessing frame is evaluated. The same processing is performed for all the codes CD in the white noise code book 21 for evaluation and selection of the optimum code $CD_{op}$ giving the minimum error power (see step c in FIG. 8).

Next, an explanation will be made of step d of FIG. 8.

First, auditory perception correction is performed, the effects of the immediately preceding processing frame are removed, and initialization performed in processing. The input signal $S_{in}$ at a time n after this is made $S_n$, the residual signal RD of the same made $e_n$, and the sampling values of the codes CD made $v_n$. Further, the linear prediction coefficient, including the auditory perception amendment filter and gain in the human auditory perception weighting processing unit 19, is made $a_i$ (same as previously mentioned $a'_i$). $v_n$ has a significant value only once every three samplings. As the residual model, the following equation is considered:

$$e_n = S_n - \sum_{i=1}^{P} a_i \cdot S_{n-i} + v_n \tag{1}$$

At this time, the evaluation function is $$\begin{aligned} E_n &= \sum_{n=0}^{N+P-1} e_n^2 \\ &= \sum_{n=0}^{N+P-1} \left( S_n - \sum_{i=1}^{P} a_i \cdot S_{n-i} + v_i \right)^2 \\ &= \sum_{n=0}^{N+P-1} \left( S'_n - \sum_{i=1}^{P} a_i \cdot S_{n-i} \right)^2 \end{aligned} \tag{2}$$

ps Where, $S'_n = S_n + V_n$ (n=3m, m being a positive integer)

$S'_n = S_n$ (n=3m+1, 3m+2)

On the other hand, the $a_i$ which gives the minimum error ER (where i=1 to p) is found from $dE_n/da_m = 0$, so $$2 \sum_{n=0}^{N+P-1} \left( S'_n - \sum_{i=1}^{P} a_i \cdot S_{n-i} \right) S_{n-k} = 0$$

is found and by this $$Q(k) = \sum_{i=1}^{P} a_i \cdot R(i-k)(k = 1 \text{ to } p) \tag{3}$$

is obtained. Here, $$Q(k) = \sum_{n=0}^{N+P-1} (S'_n \cdot S_{n-k})$$

$$R(i-k) = \sum_{n=0}^{N+P-1} (S_{n-i} \cdot S_{n-k}).$$

In the end, $a_i$ may be found by solving the equation system of

Further, in the linear predictive analysis of step a in FIG. 8, use is made of R(k) instead of the Q(k) at the left side of equation (3) and $a_i$ is calculated by the known Le loux method or other known algorithms, but $a_i$ may be calculated by the exact same thinking as in equation (3) too.

In equation (3), reevaluation is made free from the effects of $v_n$ found by the process of steps a and b of FIG. 8, so the quality of the reproduced signal is improved.

Above, an explanation was made of the case of M=3, but same applies to another value of M.

Therefore, it is possible to reduce the required amount of filter calculation by a rate substantially proportional to the thinning rate of the content of the original code book 11 and it is possible to realize by relatively small sized hardware the speech coding of real time processing.

Figure 9A:
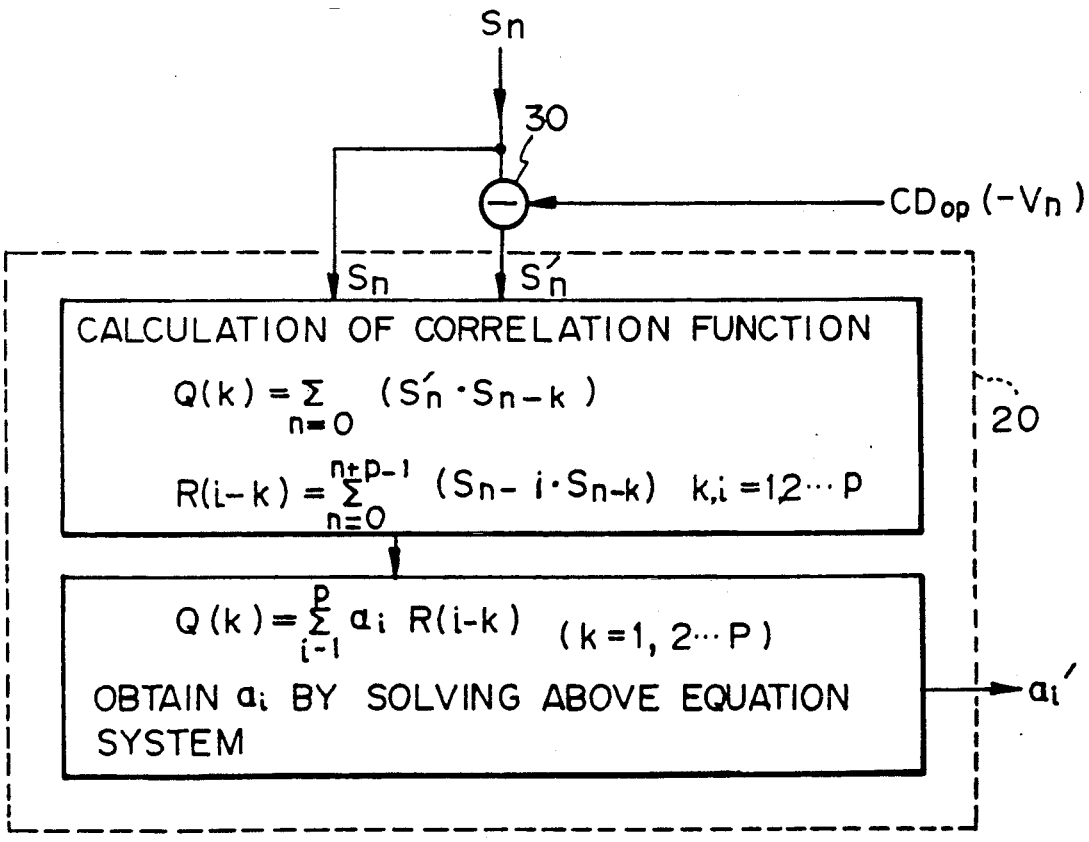
FIG. 9A is a view of the construction of the additional linear predictive analysis unit introduced in the present invention.
Figure 9B:
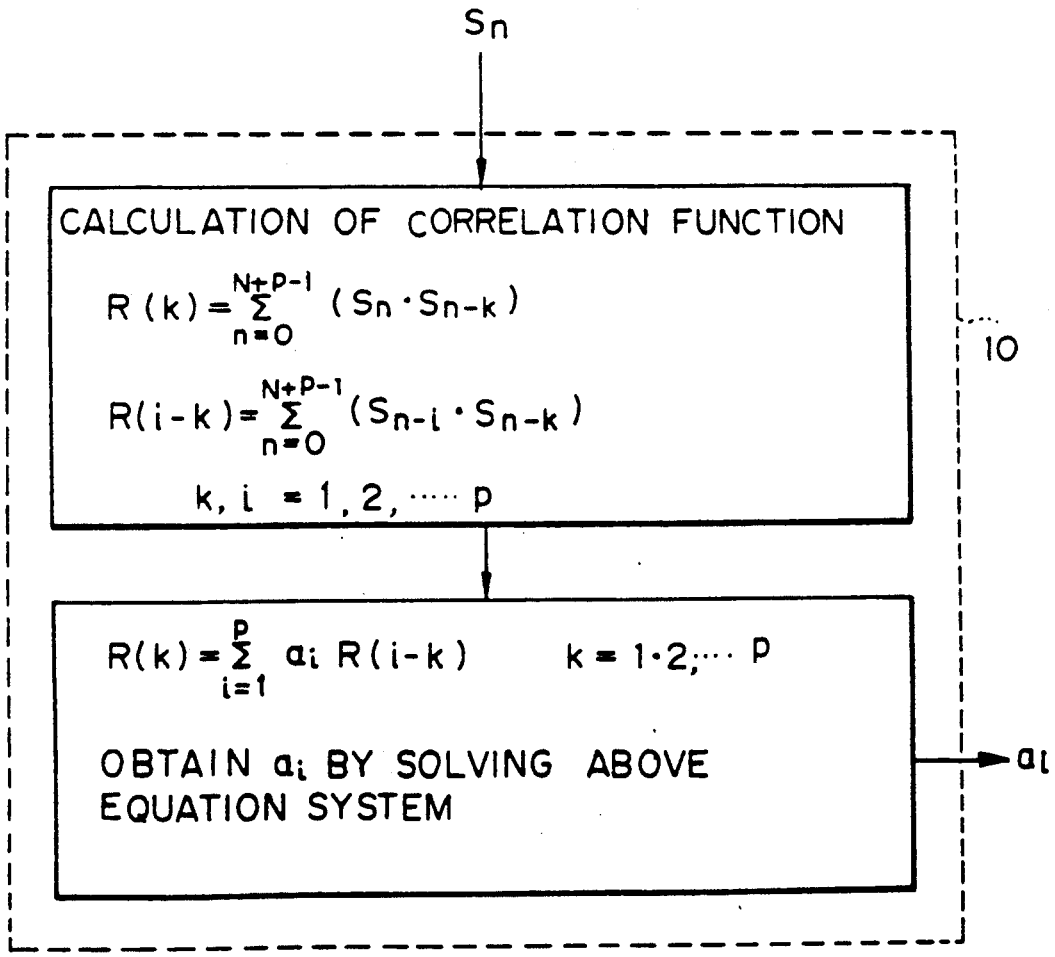
Fig. 9B PRIOR ART
FIG. 9B is a view of the construction of a conventional linear predictive analysis unit.

FIG. 9A is a view of the construction of the additional linear predictive analyzing and processing unit introduced in the present invention. FIG. 9B is a view of the construction of a conventional linear predictive analysis unit. In the figures, the differences in the hardware and processing between the linear predictive analysis unit 10 (FIG. 9B) used in the same way as the past and the additional linear predictive analysis unit 20 (FIG. 9A) added in the present invention are clearly shown. In particular, in the hardware, a subtraction unit 30 is provided and the following are realized in the above-mentioned equation (2):

$$S'_n = S_n + v_n \ (n = 3m)$$

$$S'_n = S_n \ (n = 3m+1, 3m+2)$$

The optimum code (thinned sampling value when n=3m+1 and 3m+2 is 0. S, becomes equal to $S_n$.

Next, giving a supplementary explanation of the error evaluation unit 14, the error evaluation unit 14 calculates the value of the evaluation function $$E_n = \sum_{n=0}^{N+P-1} e_n^2$$

corresponding to all the codes. For example, if the size of the code book 21 is 1024, 1024 ways of $E_n$ are calculated. Selection is made, as the optimum code ($CD_{op}$) of the code giving the minimum value of this $E_n$.

Figure 10:
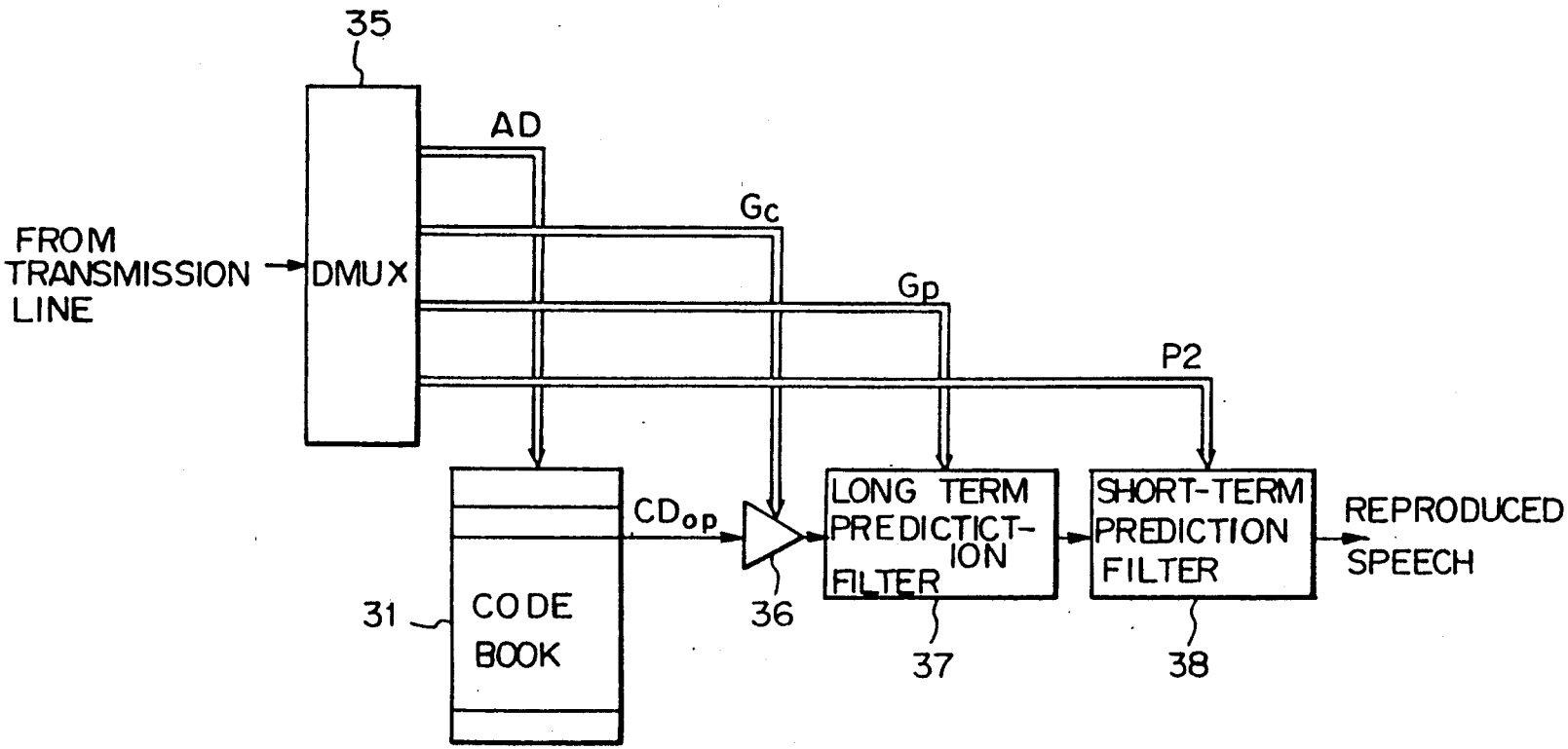
FIG. 10 is a view of the construction of the receiver side which receives coded output signals transmitted from the output unit of FIG. 7.

FIG. 10 is a view of the construction of the receiver side which receives coded output signals transmitted from the output unit of FIG. 7. According to the present invention, as the code book, use is made of the special code book 21 consisting of thinned sampling values of the codes. Also, use is made in the receiver side of an amended linear prediction parameter $P_2$. Therefore, it is necessary to modify the design of the receiving side which receives the coded output signal $S_{out}$ through a wireless transmission line, for example, compared with the past.

At the first stage of the construction of the receiving side, there is an input unit 35 which faces to the output unit 15 of FIG. 7. The input unit 35 is a demultiplexer (DMUX) and demultiplex on the receiving side the signals AD, $G_c$, $G_p$, and $P_2$ input to the output unit 15 of FIG. 7. The code book 31 used on the receiving side is the same as the code book 21 of FIG. 7. The sampling values of the codes are thinned to 1/M. The optimum code read from the code book 31 passes through an amplifier 36, long-term prediction filter 37, and short-term prediction filter 38 to become the reproduced speech. These constituent elements correspond to the amplifier 16, filter 17, and filter 18 of FIG. 7.

Figure 11:
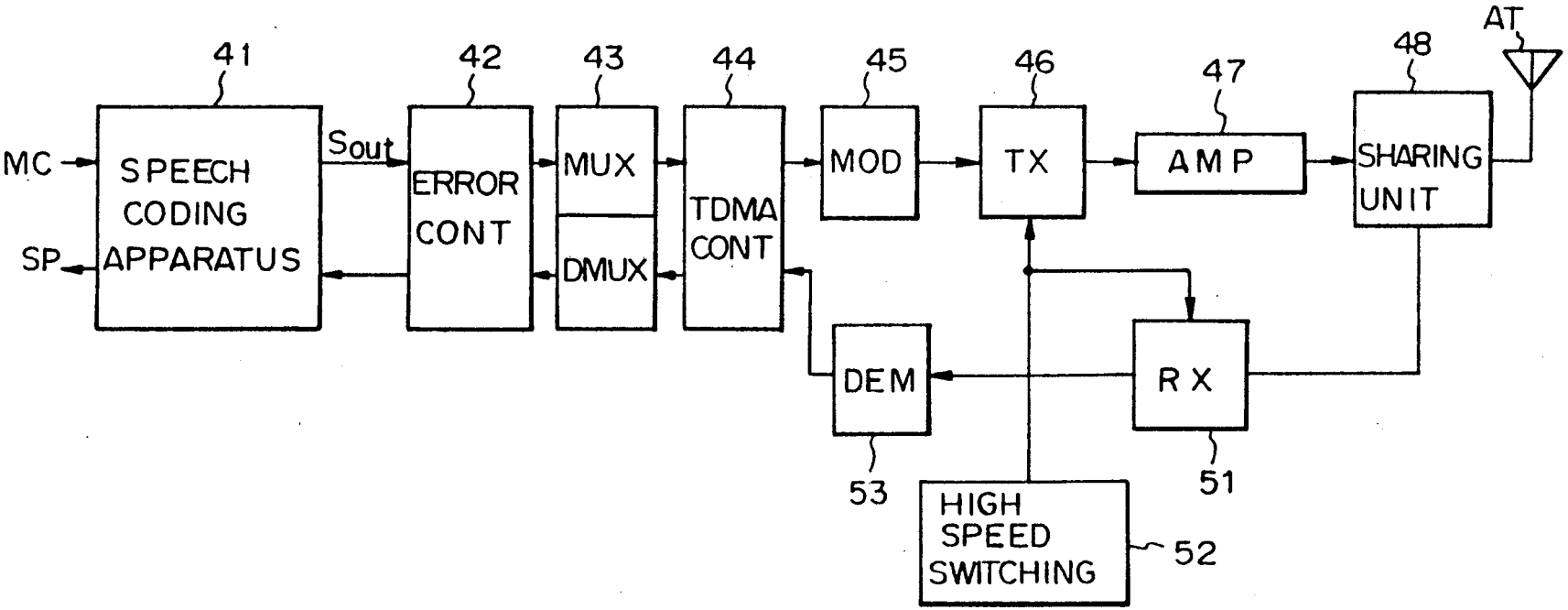
FIG. 11 is a block diagram of an example of the application of the present invention.

FIG. 11 is a block diagram of an example of the application of the present invention. The example is shown in the application of the present invention to the transmitting and receiving sides of a digital mobile radio communication system. In the FIGURE, 41 is a speech coding apparatus of the present invention (where the receiving side has the structure of FIG. 10). The coded output signal $S_{out}$ from the apparatus 41 is multiplexed through an error control unit 42 (demultiplexed at the receiving side) and applied to a time division multiple access (TDMA) control unit 44. Further, the carrier wave modulated at a modulator 45 is converted to a predetermined radio frequency by a transmitting unit 46, then amplified in power by a linear amplifier 47 and transmitted through an antenna sharing unit 48 and an antenna AT.

The signal received from the other side travels from the antenna AT through the antenna sharing unit 48 to the receiving unit 51 where it becomes an intermediate frequency signal. Note that the receiving unit 51 and transmitting unit 46 are alternately active. Therefore, there is a high speed switching type synthesizer 52. The signal from the receiving unit 51 is demodulated by the demodulator 53 and becomes a base band signal.

The speech coding apparatus 41 receives human speech caught by a microphone MC through an A/D converter (not shown) as the already explained input signal $S_{in}$. On the other hand, the signal received from the receiving unit 51 finally becomes reproduced speech (reproduced speech in FIG. 10) and is transmitted from a speaker SP.

As explained above, according to the present invention, it is possible to operate in real time a speech coding apparatus based on the CELP method without use of a large computer, that is, using a small sized digital signal processor (DSP).

We claim:

1. A speech coding apparatus comprising:

a linear predictive analysis unit which receives an input signal of digitalized speech, performs linear prediction, and extracts a linear prediction parameter;

a code book which stores codes comprised of white noise series;

a prediction filter unit, operatively connected to said linear predictive analysis unit and to said code book, which uses the linear prediction parameter and the codes for filter calculations to produce a reproduced signal;

a comparator, operatively connected to said prediction filter unit and receiving as input the reproduced signal and the input signal, and comparing the reproduced signal to the input signal to produce an error signal;

an error evaluation unit, operatively connected to said comparator and said code book, and calculating an optimum code giving a minimum error signal; and an output unit, operatively connected to said linear predictive analysis unit and said code book, and receiving the optimum code and the linear prediction parameter, outputting a coded output signal;

wherein the said code book comprises a reduced code book only storing reduced codes formed by thinning said code book to 1/M (M being an integer of two or more) of the sampling values inherently possessed by the code book wherein said reduced codes are formed by thinning the codes at predetermined intervals to produce thinned codes in said code book.

2. An apparatus as set forth in claim 1, wherein the M is 2 or 3.

3. An apparatus as set forth in claim 1, wherein a data value "0" is written in the thinned codes.

4. An apparatus as set forth in claim 1, wherein said prediction filter unit comprises a digital signal processor.

5. An apparatus as set forth in claim 1, further comprising means for compensating the a deterioration of quality of the reproduced signal caused by thinning the codes.

6. An apparatus as set forth in claim 5, further comprising a human auditory perception weighing unit, operatively connected between said error evaluation unit and said comparator, and weighing the error signal by matching the thinned codes with a human auditory spectrum.

7. An apparatus as set forth in claim 6, further comprising:

a second human auditory perception weighting processing unit, receiving as input the input signal;

a third human auditory perception weighting processing unit, receiving as input the input signal;

a signal comparator, operatively connected between second human auditory perception unit, said third human auditory perception unit, and said comparator, and receiving as input and comparing the output of said second human auditory perception unit and said third human auditory perception unit, and producing an output an input to said comparator.

8. A speech coding apparatus as set forth in claim 7, wherein said second linear predictive analysis unit comprises first and second prediction filters and produces the second linear prediction parameter by calculating a linear prediction parameter giving a minimum squared sum of the residual signal obtained by applying the optimum code to the first prediction filter and applying a deviation component to the second prediction filter.

9. A speech coding apparatus comprising:

a linear predictive analysis unit which receives an input signal of digitalized speech, performs linear prediction, and extracts a linear prediction parameter;

a code book which stores codes comprised of white noise series;

a prediction filter unit, operatively connected to said linear predictive analysis unit and to said code book, which uses the linear prediction parameter and the codes for filter calculations to produce a reproduced signal;

a comparator, operatively connected to said prediction filter unit and receiving as input the reproduced signal and the input signal, and comparing the reproduced signal to the input signal to produce an error signal;

an error evaluation unit, operatively connected to said comparator and said code book, and calculating an optimum code giving a minimum error signal;

an output unit, operatively connected to said linear predictive analysis unit and said code book, and receiving the optimum code and the linear prediction parameter, outputting a coded output signal; and wherein the said code book comprises a reduced code book only storing reduced codes formed by thinning said code book to 1/M (M being an integer of two or more) of the sampling values inherently possessed by the code book;

further comprising means for compensating for a deterioration of quality of the reproduced signal caused by thinning the codes; and wherein said compensating means comprises an additional linear predictive analysis unit, operatively connected to said code book and to said output unit, and receiving as input the input signal and the optimum code, said additional linear prediction analysis unit calculating an amended linear prediction parameter output to said output unit.

10. An apparatus as set forth in claim 9, wherein said additional linear predictive analysis unit calculates an amended linear prediction parameter from a minimum squared sum of a residual component obtained after removal of an effect of the optimum code from the input signal.

11. An apparatus as set forth in claim 10, further comprising a subtraction unit, operatively connected to said linear predictive analysis unit, which receives as input the input signal and inputs to said additional linear predictive analysis unit a value obtained by subtracting the optimum code from the input signal.

12. A speech coding apparatus for coding a speech signal, comprising:

a code book having codes;

a first linear predictive analysis unit, receiving as input the speech signal and producing a first linear prediction parameter;

a prediction filter unit, operatively connected to said code book and said first linear predictive analysis unit, receiving as input the codes and the first linear prediction parameter and producing a reproduced signal;

a comparator, operatively connected to said prediction filter unit, receiving as input the speech signal and the reproduced signal, and producing an error signal;

an error evaluation unit, operatively connected to said comparator and said code book, receiving as input the codes and the error signal and calculating an optimum code that produces a minimum error signal;

a second linear predictive analysis unit, operatively connected to said code book, and receiving as input the speech signal and the optimum code, producing a residual signal, and calculating a second linear prediction parameter; and an output unit, operatively connected to said code book and said second linear predictive analysis unit, receiving as input the optimum code and the second linear prediction parameter, and producing as output a coded output signal.

13. A speech coding apparatus as set forth in claim 12, wherein said second linear prediction analysis unit includes a prediction inverse filter, and obtains the deviation component by calculating a difference between the optimum code and a residual signal obtained by applying the speech signal to the prediction inverse filter.

* * * * *